US006035249A

United States Patent [19]

Yamamoto et al.

[11] Patent Number: 6,035,249

[45] Date of Patent: Mar. 7, 2000

[54] SYSTEM FOR DETERMINING THE POSITION OF A BULLDOZER

[75] Inventors: Shigeru Yamamoto; Hidekazu Nagase, both of Osaka, Japan

[73] Assignee: Komatsu Ltd., Tokyo, Japan

[21] Appl. No.: 08/944,444

[22] Filed: Oct. 6, 1997

[30] Foreign Application Priority Data

Oct. 8, 1996 [JP] Japan ..... 8-266844

[51] Int. Cl.[7] ..... G06F 7/70; E02F 3/00

[52] U.S. Cl. ..... 701/50; 701/1; 180/197; 172/4.5; 172/7; 172/811; 340/988

[58] Field of Search ..... 701/50, 1; 180/197; 172/4.5, 7, 811, 812, 821; 340/988, 992

[56] References Cited

U.S. PATENT DOCUMENTS 5,219,411 6/1993 Yamamoto et al. ..... 180/197
5,287,280 2/1994 Yamamoto et al. ..... 701/84

FOREIGN PATENT DOCUMENTS 55-36776 9/1980 Japan .
61-599449 3/1986 Japan .
61-201176 9/1986 Japan .
3-43523 2/1991 Japan .
7-26586 1/1995 Japan .

*Primary Examiner*—William A. Cuchlinski, Jr.
*Assistant Examiner*—Yonel Beaulieu
*Attorney, Agent, or Firm*—Armstrong, Westerman, Hattori, McLeland & Naughton

[57] ABSTRACT

An improved accuracy is ensured for the calculation of the travel distance of a bulldozer by obtaining the accurate vehicle speed and travel direction of the bulldozer. To this end, arrangement is made such that a check is made to determine whether actual tractive force F exerted on the blade exceeds a predetermined shoe slip threshold value $F_0$; switching between vehicle speed detectors (between a Doppler sensor and Sprocket rotating speed detector) is made according to the determination so that suitable one of the vehicle speed detectors detects the vehicle speed of the bulldozer; and the vehicle speed detected by the selected vehicle speed detector is integrated, whereby the travel distance of the bulldozer is calculated.

11 Claims, 13 Drawing Sheets

SYSTEM FOR DETERMINING THE POSITION OF A BULLDOZER

TECHNICAL FIELD

The present invention relates to a bulldozer location system for determining the present position of a bulldozer by obtaining the distance the bulldozer has traveled from a digging start position.

BACKGROUND ART

There has been proposed, an automatic driving technique for bulldozers, for example, in Japanese Patent Laid-Open Publication No. 7-26586(1995), according to which a bulldozer is automatically driven by radio control or the like within a specified lane when manual driving by the operator is impossible or too dangerous to carry out during digging/carrying operation.

In such automatic driving, accurate measurements of the vehicle speed (ground speed) and travel direction of the vehicle are necessary to establish the present position of the bulldozer. The following methods for measuring the speed of a track-laying vehicle such as a bulldozer are generally known: (1) Vehicle speed is determined from the rotating speed of the crawler belts, that is, the rotating speed of the sprockets for the crawler belts. (2) Vehicle speed is detected by a Doppler sensor (Doppler vehicle speed). It is generally known that the vehicle speed detection based on the rotating speed of the crawler belt sprockets is more accurate than the detection by a Doppler sensor.

The detection based on the rotating speed of the sprockets, however, presents the disadvantage that the vehicle speed detection cannot be accurately carried out when there occurs a slip (shoe slip) in the crawler belts due to increases in the load on the blade (i.e., actual tractive force).

For accurately determining the travel direction of a vehicle body, it is necessary to clearly distinguish, for example, between when the vehicle travels forward with the crawler belts being not parallel with the ground level and when the vehicle travels forward along a slope.

Accordingly, the present invention is directed to solving the above problems and one of the objects of the invention is therefore to provide a bulldozer location system capable of providing greatly improved accuracy in calculation of a travel distance by obtaining the accurate vehicle speed and travel direction of a bulldozer.

DISCLOSURE OF THE INVENTION

The above object can be accomplished by a bulldozer location system for determining the present position of a bulldozer by obtaining the distance the bulldozer has traveled from a digging start position, the system comprising:

(1) actual tractive force detecting means for detecting the actual tractive force exerted on a blade;

(2) determining means for determining whether the actual tractive force detected by the actual tractive force detecting means exceeds a predetermined shoe slip threshold value;

(3) vehicle speed detector switching means for switching from one vehicle speed detector means to another according to the determination by the determining means such that one of a plurality of vehicle speed detector means is selected for use in detecting the vehicle speed of the bulldozer; and (4) travel distance calculating means for obtaining the travel distance by integrating the vehicle speed detected by the selected vehicle speed detector means.

In the invention, the load (actual tractive force) exerted on the blade during digging or carrying operation is detected by the actual tractive force detecting means and the determining means determines whether or not the detected actual tractive force exceeds a predetermined shoe slip threshold value. According to the determination by the determining means, the vehicle speed detector switching means switches from one vehicle speed detector means to another so that one of a plurality of vehicle speed detector means is selectively used to detect the vehicle speed of the bulldozer. The vehicle speed detected by the selected vehicle speed detector means is integrated to obtain the travel distance the bulldozer has traveled from a digging start position, and the present position of the bulldozer can be established from the travel distance. In the invention, whether or not the slip of the crawler belts (shoe slip) has occurred is determined by the degree of the load exerted on the bulldozer, and a suitable vehicle speed detector means is selected according to the determination, so that the vehicle speed of the bulldozer can be accurately detected, which results in the improved accuracy of the calculation of the travel distance.

Preferably, the vehicle speed detector switching means according to the invention switches to a first vehicle speed detector means incorporating a Doppler sensor when the determining means determines that the detected actual tractive force exceeds the predetermined shoe slip threshold value, and switches to a second vehicle speed detector means which detects vehicle speed from the rotating speed of the sprockets for the crawler belts when the determining means determines that the detected actual tractive force does not exceed the predetermined shoe slip threshold value. With this arrangement, when the actual tractive force is equal to or less than the shoe slip threshold value and no shoe slip occurs, the vehicle speed of the bulldozer is detected from the rotating speed of the sprockets for the crawler belts. When the actual tractive force increases, exceeding the shoe slip threshold value, the vehicle speed is detected by the Doppler sensor. This enables accurate vehicle speed detection according to the driving condition of the bulldozer.

The predetermined shoe slip threshold value is preferably set to the lower limit of the variation range of shoe slip which varies depending on soil property. This permits the switching control on the vehicle speed detector means to be constantly performed even if shoe slip varies according to soil property.

The system of the invention further comprises: (1) pitch angle detecting means for detecting the pitch angle of a vehicle body; (2) implement reaction force detecting means for detecting the reaction force exerted on an implement; (3) implement angle detecting means for detecting the angle of the implement relative to the vehicle body; and (4) travel direction angle calculating means for calculating the angle of travel direction of the vehicle based on outputs from the pitch angle detecting means, the implement reaction force detecting means and the implement angle detecting means. In this arrangement, the vehicle speed is integrated in the direction of the travel direction angle of the vehicle calculated by the travel direction angle calculating means, whereby the route the bulldozer has traveled can be accurately obtained.

Preferably, the travel direction angle calculating means calculates the angel of travel direction of the vehicle by subtracting the implement angle detected by the implement angle detecting means from the pitch angle of the vehicle body detected by the pitch angle detecting means, when the reaction force detected by the implement reaction force detecting means exceeds a predetermined value.

The pitch angle detecting means may detect the pitch angle of the vehicle body from the output of a pitch angle sensor. The implement reaction force detecting means may detect the reaction force exerted on the implement from the oil pressure supplied to an implement cylinder for from the axial force of the cylinder. Alternatively, the reaction force may be detected from the load imposed on a cylinder-mounting pin. The implement angle detecting means detects the angle of the implement relative to the vehicle body from the output of a sensor for sensing the angle of an implement cylinder-mounting yoke or from the output of a sensor for sensing the stroke of the cylinder.

BEST MODE FOR CARRYING OUT THE INVENTION

With reference to the accompanying drawings, a preferred embodiment of the bulldozer location system of the invention will be described.

Figure 1:
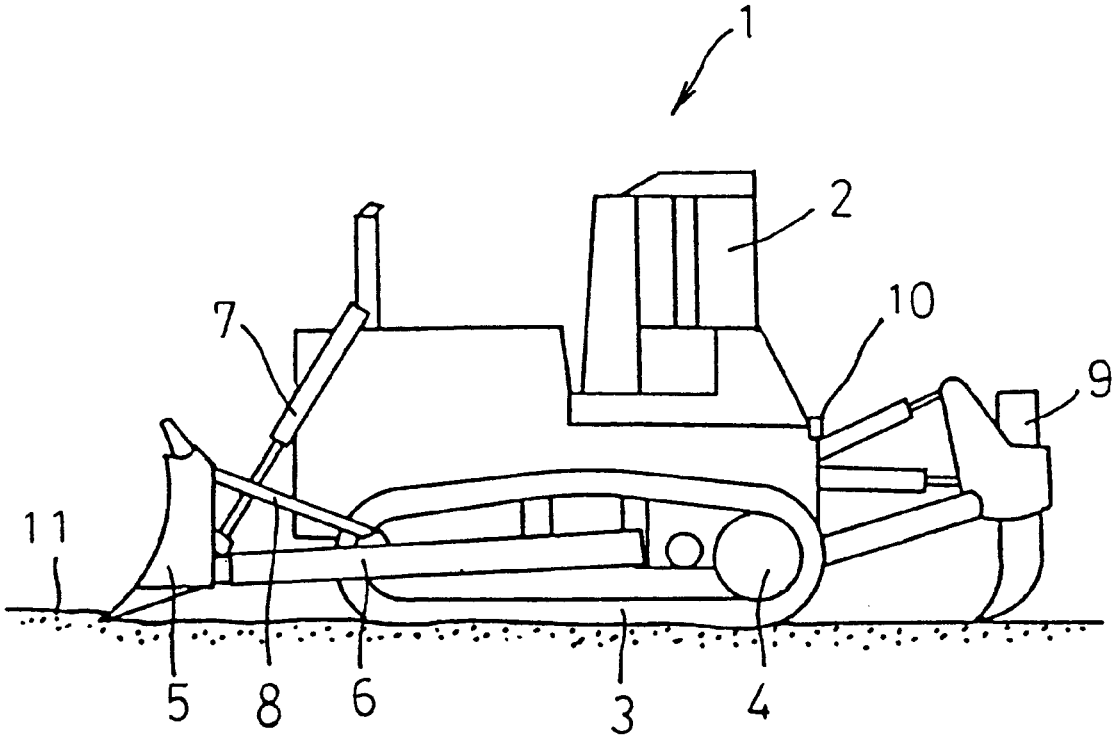
FIG. 1 is a general side view of a bulldozer according to an embodiment of the invention.

As shown in FIG. 1, a bulldozer 1 according to this embodiment includes a vehicle body 2 both sides of which with respect to its moving direction are provided with crawler belts 3 for driving the vehicle body 2 such that it can move forward or backward or turn. The right and left crawler belts 3 are independently driven by their respective sprockets 4 that are actuated by driving force transmitted from the engine. In the front part of the vehicle body 2, there are provided right and left straight frames 6 for supporting a blade 5 at their forward ends. The base ends of these right and left straight frames 6 are pivotally supported by trunnions. Disposed between the blade 5 and the vehicle body 2 are right and left blade lift cylinders 7 arranged in a pair for lifting or lowering the blade 5. For tilting the blade 5 to the right or left, a brace 8 and blade tilt cylinders (not shown) are provided between the blade 5 and the straight frames 6. A ripper 9 is disposed in the rear part of the vehicle body 2.

For obtaining the route that the above-described bulldozer 1 has traveled, the accurate ground speed of the vehicle body 2 needs to be obtained. When the bulldozer 1 is in operation, there occurs a slip in the crawler belts (i.e., shoe slip), and therefore, an error arises if vehicle speed is detected based on the rotating speed of the sprockets.

Figure 2:
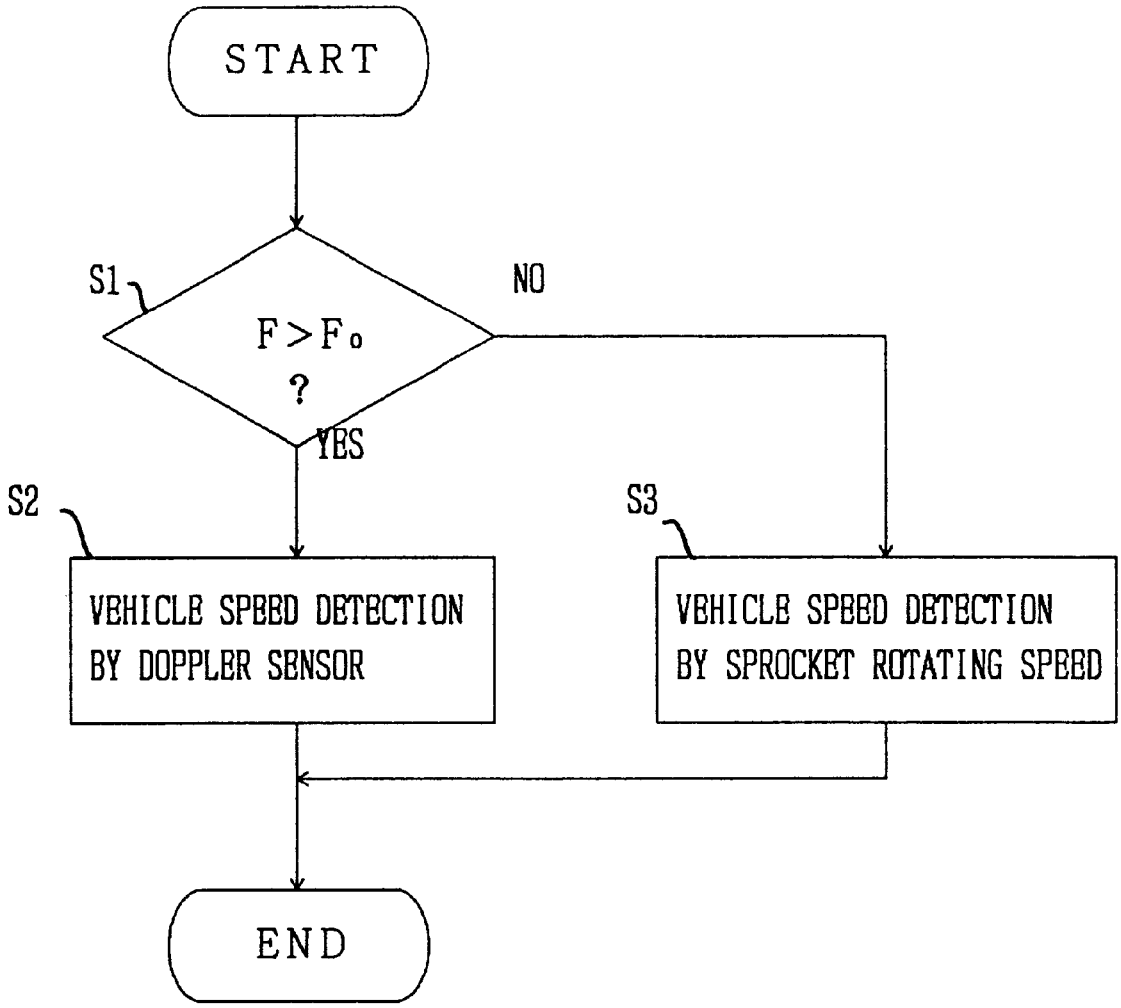
FIG. 2 is a flow chart of a logic for vehicle speed detection in the embodiment.

To solve this problem, the embodiment is designed such that a determination as to whether the bulldozer is in a traveling state or operating (digging or carrying) state is made by determining whether the actual tractive force exerted on the blade 5 exceeds a predetermined shoe slip threshold value and a suitable vehicle speed detecting means is selected according to the determination of the state to accurately measure the vehicle speed of the bulldozer 1. Next, this control logic will be described with reference to the flow chart of FIG. 2.

Figure 3:
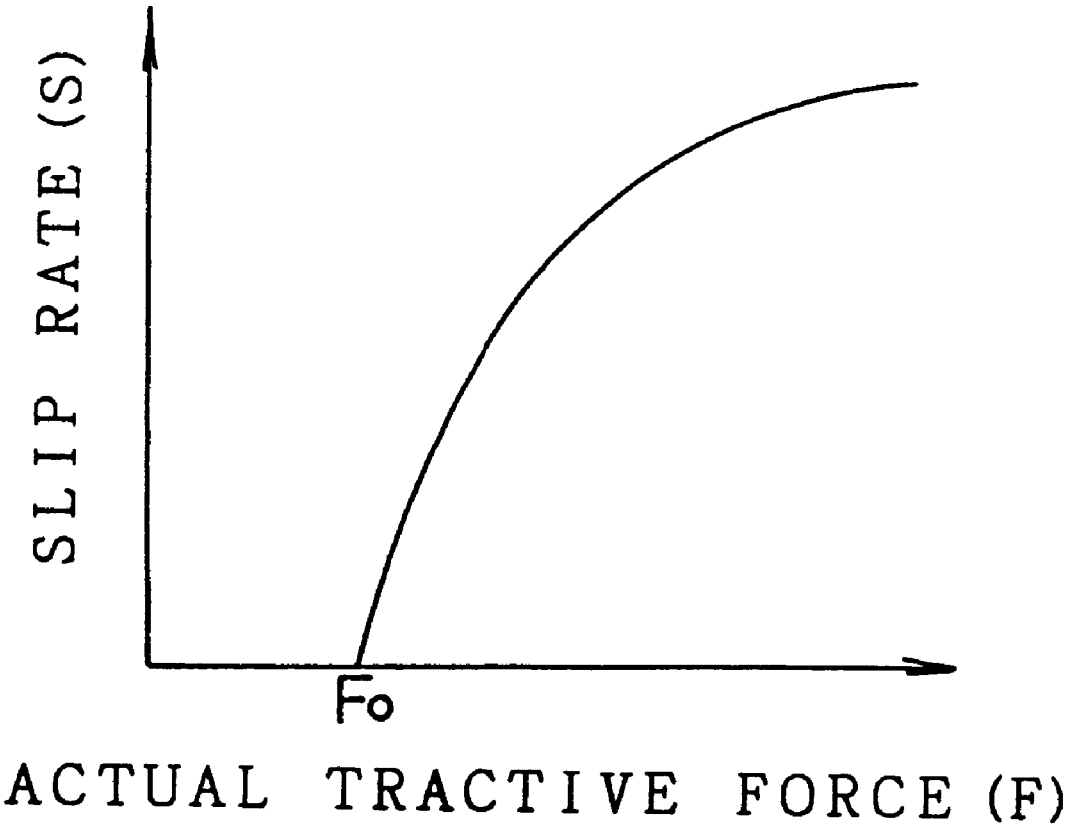
FIG. 3 is a graph showing the relationship between actual tractive force and slip rate.

S1: A check is made to determine whether or not the actual tractive force F exerted on the blade 5 exceeds the predetermined shoe slip threshold value $F_0$. The relationship between the rate S of slip which would occur in the crawler belts 3 and the actual tractive force F is shown in FIG. 3. Although the shoe slip threshold value $F_0$ varies according to soil property, it is preferably set to the lower limit of the variation range of shoe slip. For example, the shoe slip threshold value $F_0$ may be set to 0.4W (W=the total weight of the bulldozer 1). The actual tractive force F may be obtained by calculation based on a detected value of engine speed or by detecting the driving torque of the sprockets 4. Alternatively, it may be obtained by detecting the bending stress that is exerted on the trunnions by the straight frames 6 for supporting the blade 5.

Figure 4:
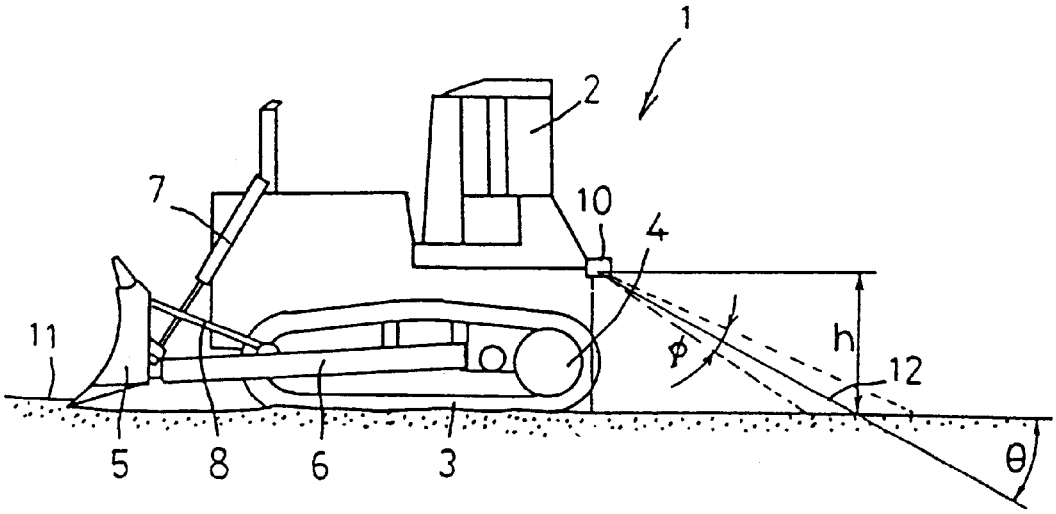
FIG. 4 is a view for explaining the principle of vehicle speed detection by a Doppler sensor.

S2: If the actual tractive force F exceeds the shoe slip threshold value $F_0$, vehicle speed is detected by a Doppler sensor 10 attached to the vehicle body 2. This vehicle speed detection is carried out in such a way that the Doppler sensor 10 directs an electromagnetic wave beam 12 onto the ground 11 at a predetermined angle of depression θ (i.e., a sensor minus angle) and receives a reflection wave reflected off the ground 11, and the vehicle speed of the bulldozer 11 relative to the ground is calculated based on the transmitted wave and the received wave. In FIG. 4, ϕ designates the angle of deflection of the beam.

The above-described Doppler sensor 10 incorporated in the vehicle speed detector arcs about the center of rotation of the vehicle due to pitching of the vehicle body and this arcing motion is followed by the rotating motion of the Doppler sensor 10. The vehicle speed detection of this embodiment incorporates correction terms for compensating for the arcing motion and rotating motion of the Doppler sensor 10. More specifically, since the speed of the electromagnetic wave in the radiating direction is represented by v cosθ where v is the actual vehicle speed of the bulldozer 1 (see FIG. 5(*a*)), the relationship between the Doppler shift frequency (beat frequency) $f_d$ and the actual vehicle speed V is described by:

$$f_d=2f_t\times v\cos\theta/C \tag{1}$$

where $f_t$ is transmitted frequency and C is the speed of propagation of electromagnetic waves (velocity of light or velocity of sound).

The correction terms for the arcing motion and rotating motion of the Doppler sensor 10 are obtained by the following procedure.

(1) Correction term $A_1$ for the arcing motion

Figure 5:
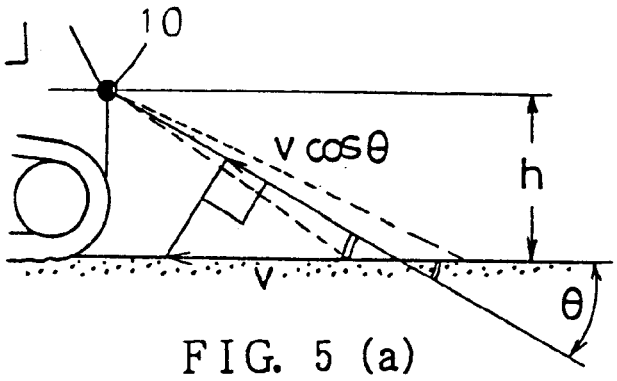
FIG. 5 is a view for explaining correction terms included in the vehicle speed detection by the Doppler sensor.
Figure 5:
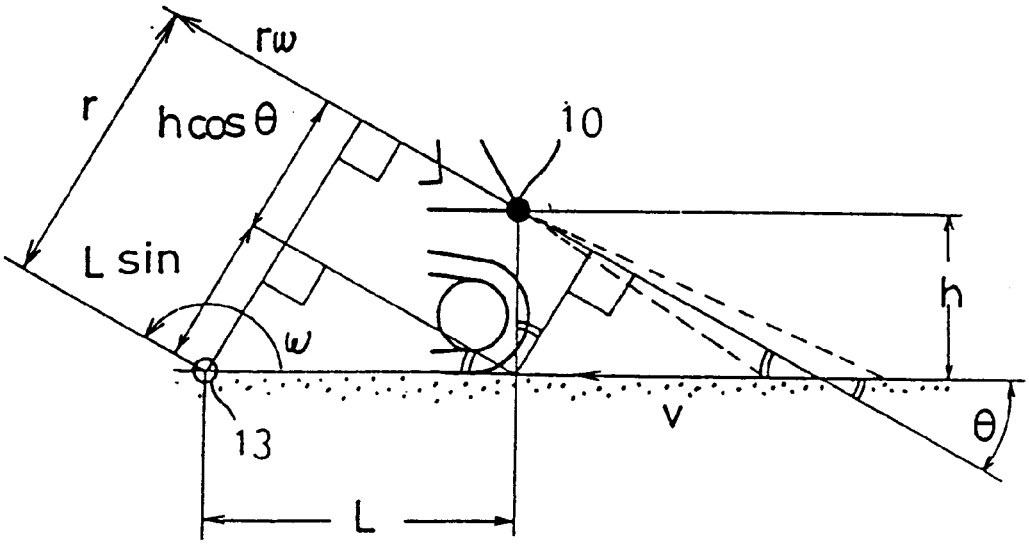
Figure 5:
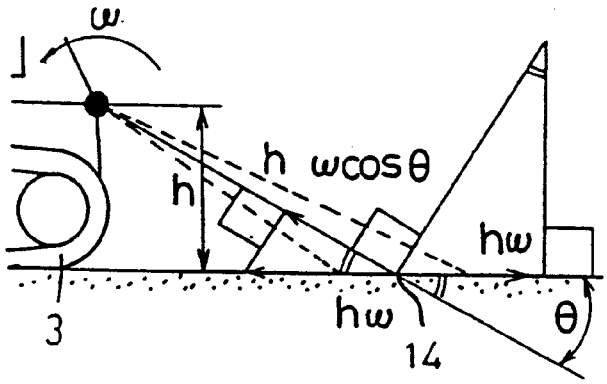

Suppose that the vehicle rotates about a center 13 as shown in FIG. 5(*b*) and the horizontal distance between the Doppler sensor 10 and the center of rotation 13 is represented by L. The effective radius r of gyration of the Doppler sensor 10 about the center of rotation 13 is given by the following equation.

$$r=h\cos\theta+L\sin\theta$$

Accordingly, the correction term $A_1$ for the arcing motion is given by the following equation, $$A_1=2f_t\times(h\cos\theta+L\sin\theta)\omega/C \tag{2}$$

(2) Correction term $A_2$ for the rotating motion

The shift speed of the reflection point 14 of the electromagnetic wave beam 12 is given by hω and the speed element of the shift speed in the electromagnetic wave radiating direction is given by hω cos θ. Therefore, the correction term $A_2$ for the rotating motion is given by the following equation.

$$A_2=2f_t\times h\omega\cos\theta/C \quad (3)$$

The following equation (4) is obtained by adding the correction terms $A_1$, $A_2$ to the equation (1).

$$f_d = 2f_t \times v\cos\theta/C \pm A_1 \pm A_2 = (2f_t/C)\{v\cos\theta \pm (h\cos\theta + L\sin\theta)\,\omega \pm h\omega\cos\theta\} \quad (4)$$

The following equation (5) is obtained from the equation (4).

$$v=(f_dC/2f_t\cos\theta)\pm 2h\omega\pm L\omega\tan\theta \quad (5)$$

In the equation (5), symbol − represents the forward travel of the vehicle while symbol + represents the backward travel of the vehicle. The horizontal distance L varies depending on the position of the center of rotation of the vehicle. The center of rotation of the vehicle changes for example when operation is carried out with either one of the crawler belts 3 being floated (lifted) over the ground. When such floating occurs in the vehicle, the angle of depression θ varies according the angle of floating.

S3: If the actual tractive force F does not exceed the shoe slip threshold value $F_0$, vehicle speed is determined from the rotating speed of the sprockets. In this way, vehicle speed can be accurately obtained taking a shoe slip into account.

Figure 6:
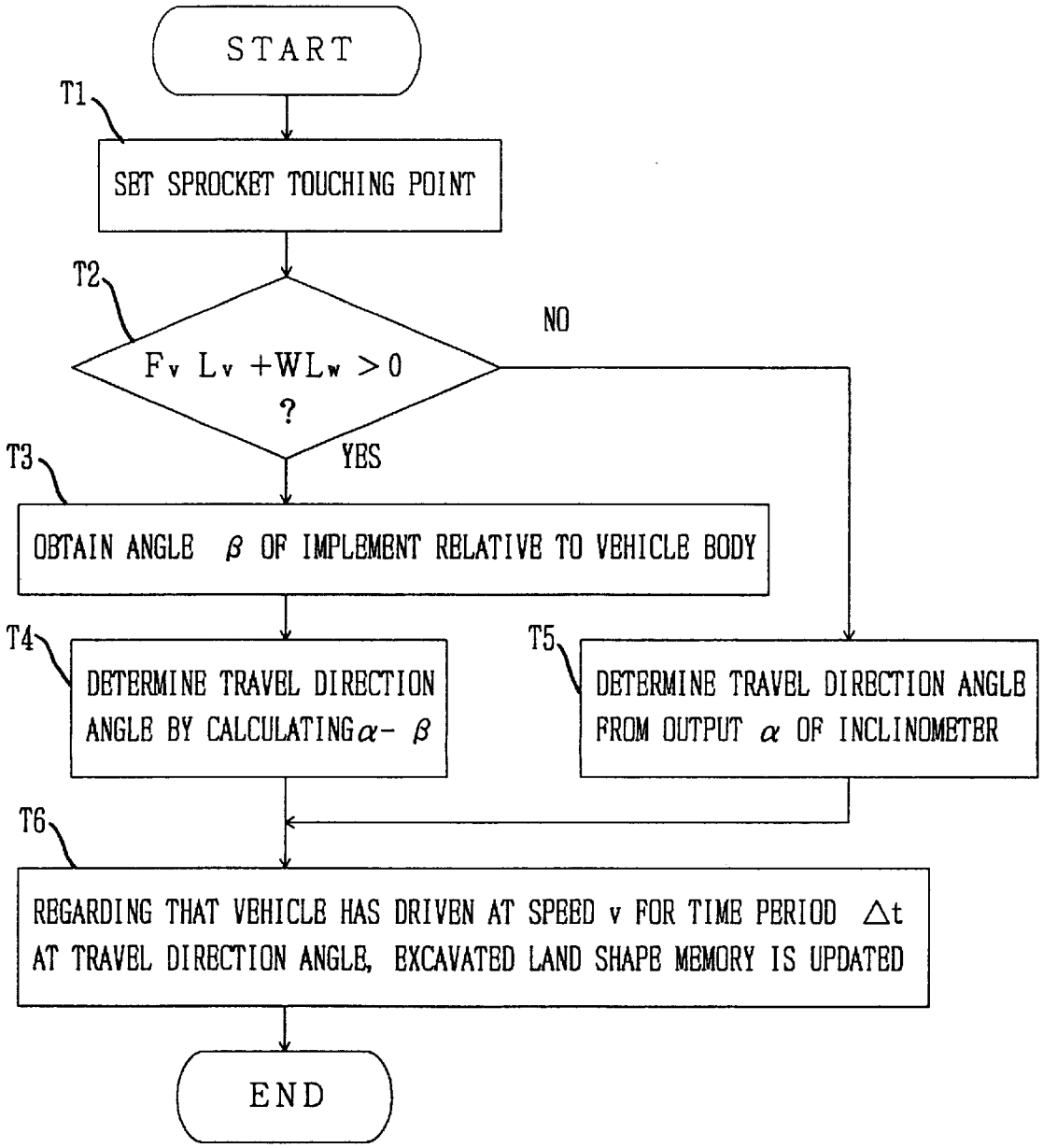
FIG. 6 is a flow chart of a logic for determining the travel direction of a vehicle body.

The travel direction of the vehicle body 2 is determined according to whether the bulldozer 1 is in a normal traveling condition or in a condition where the tip of the blade 5 does not penetrate into the ground 11 because the ground 11 is too hard and the idlers for the crawler belts are floating over the ground 11. The logic for determining the travel direction of the vehicle body 2 will be described with reference to the flow chart of FIG. 6.

Figure 7:
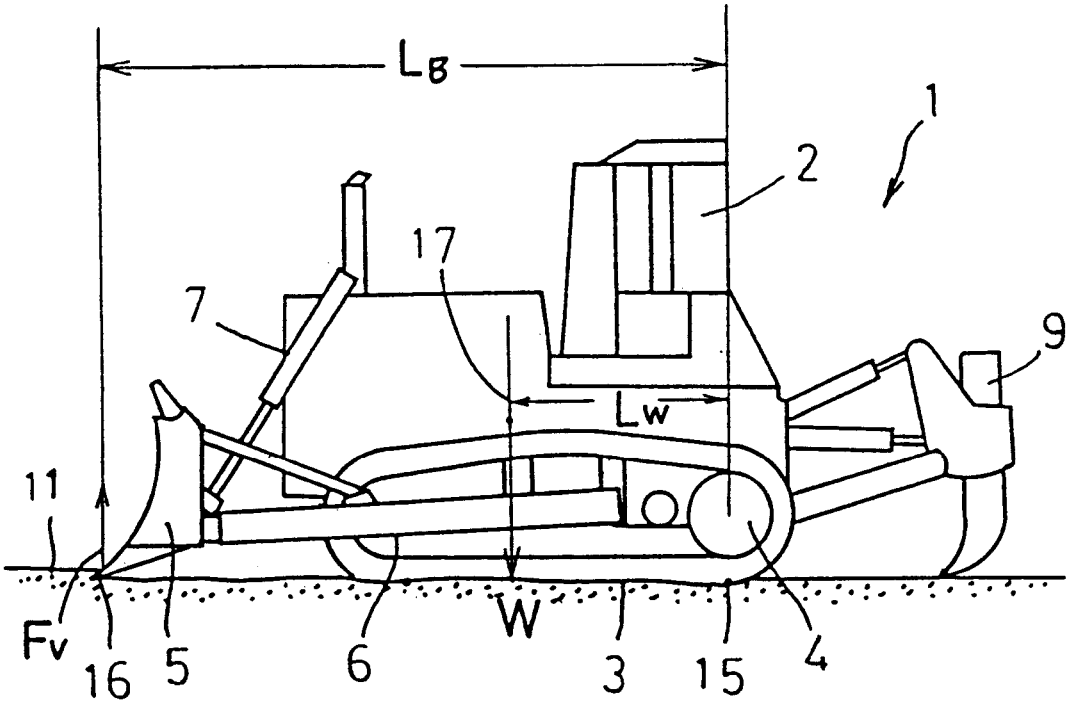
FIG. 7 is a view for explaining the balance between moments occurring in the vehicle body.

T1 to T4: A touching point 15 (see FIG. 7) at which the lower part of each sprocket 4 touches the ground 11 and which is the center of rotation of the vehicle body 2 during dozing operation is set. Then, a check is made to determine if the following equation holds.

$$F_V\times L_B+W\times L_W>0 \quad (6)$$

In the equation (6), $F_V$ is a reaction force which the blade 5 receives from the ground 11 (hereinafter called as "blade reaction force"), $L_B$ is the horizontal distance between the touching point 15 and the ground touching point 16 of the blade 5, W is the total weight of the vehicle, and $L_W$ is the horizontal distance between the touching point 15 and the center of gravity 17 of the vehicle. Note that the blade reaction force $F_V$ is calculated from the oil pressure supplied to the blade lift cylinders 7.

Figure 8:
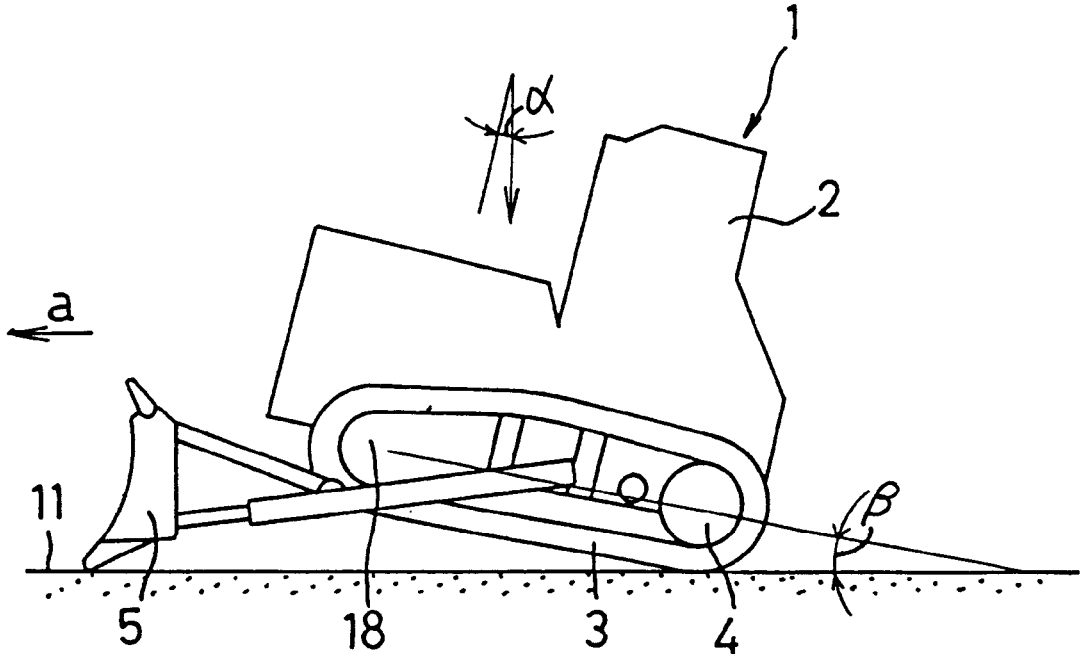
FIGS. 8 to 13 each showing the posture of the vehicle body.

When the equation (6) holds, the moment $F_V\times L_B$ of the reaction force $F_V$ exerted on the blade 5 is greater than the moment $W\times L_W$ of the weight W of the vehicle, so that the bulldozer 1 is deemed to be in such a condition that the tip of the blade 5 cannot penetrate into the ground 11, for example, in the case where the ground 11 is so hard and that the idlers 18 for the crawler belts are floating over the ground 11 as shown in FIG. 8 (idler floating condition). In this case, the angle β of the implement relative to the vehicle body 2 is obtained while the pitch angle α of the vehicle body 2 is obtained with an inclinometer, and then the angle (α−β) obtained by subtracting the angle β from the pitch angle α is determined as the angle of travel direction of the vehicle.

Figure 9:
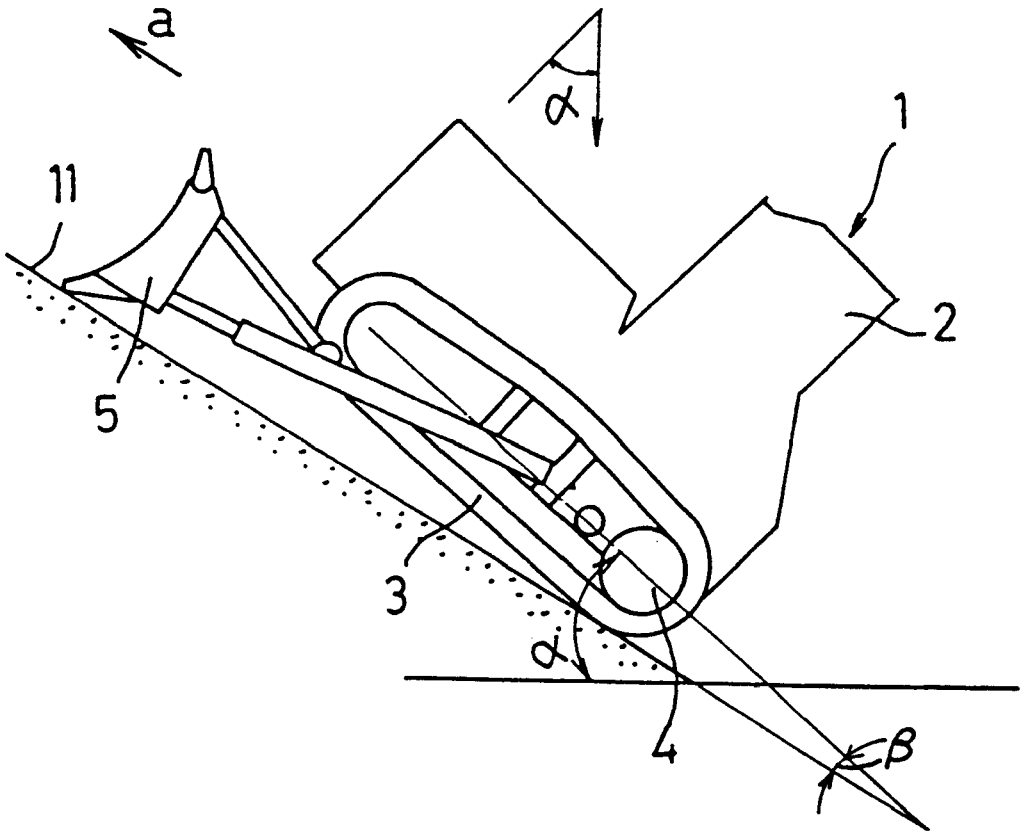
Figure 10:
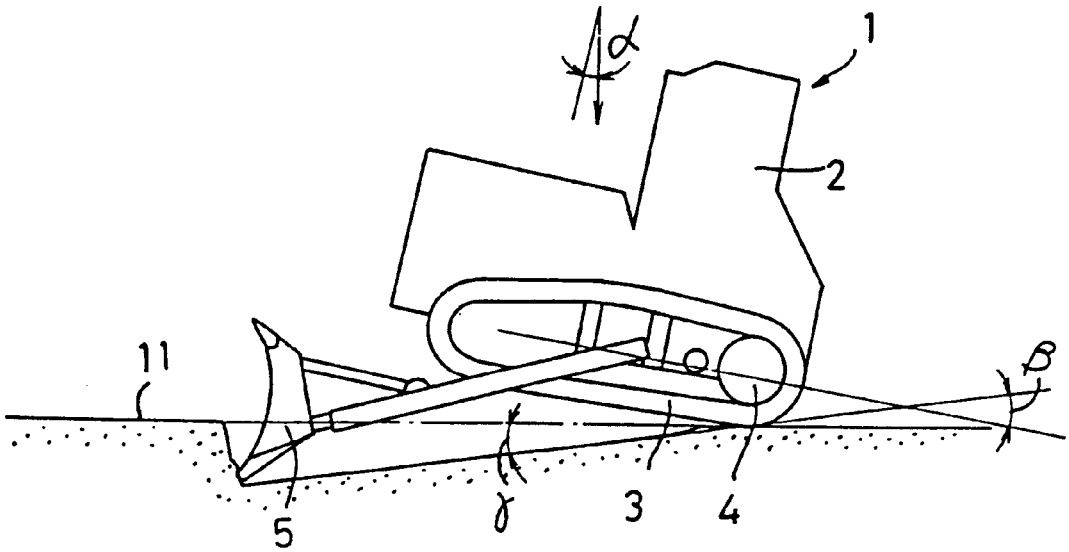
Figure 11:
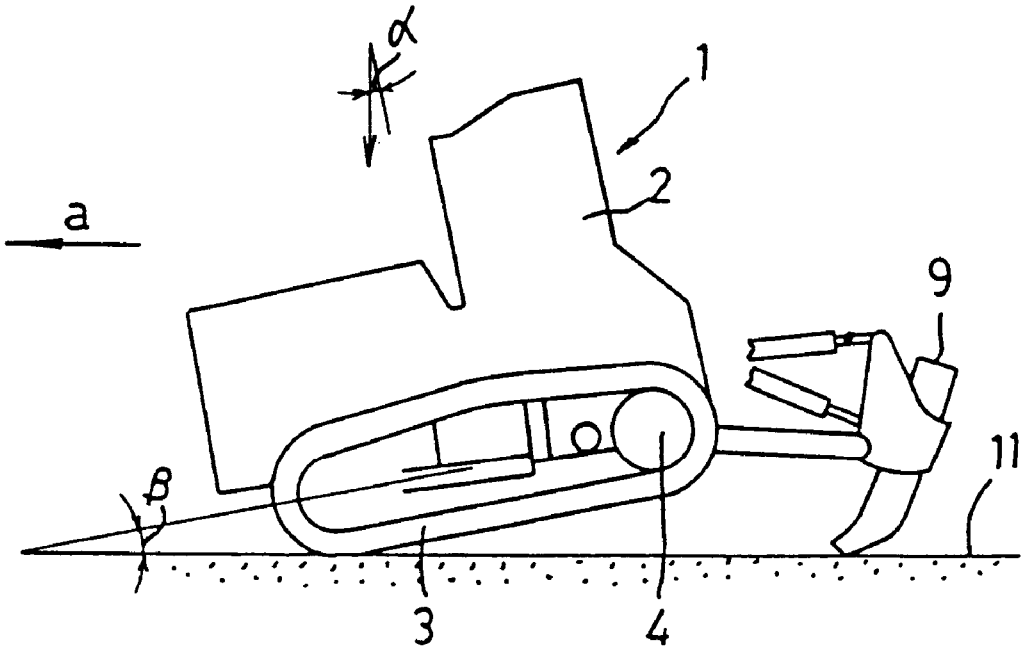

For example, when the bulldozer 1 performs digging operation, traveling along the ground 11 with the idlers being in the floating condition as shown in FIG. 8, the pitch angle α of the vehicle body 2 is coincident with the angle β of the implement so that the angle of travel direction of the vehicle body 2 is zero (α−β=0) and coincident with the direction a of the vehicle speed. When the bulldozer 1 in the above condition drives on a slope as shown in FIG. 9, the angle of travel direction of the vehicle body 2 is obtained by α−β. When the bulldozer 1 drives with the blade 5 penetrating into the ground 11 as shown in FIG. 10, the angle of travel direction of the vehicle body 2 is −γ(α−β=−γ). Note that symbol − represents a downward direction from the horizontal line. When the bulldozer 1 drives with the sprockets floating (see FIG. 11) such as during ripping operation, the angle of the implement β is equal to the pitch angle α and the angle of travel direction of the vehicle body 2 coincides with the direction a of the vehicle speed, similarly to the idler floating condition.

Figure 12:
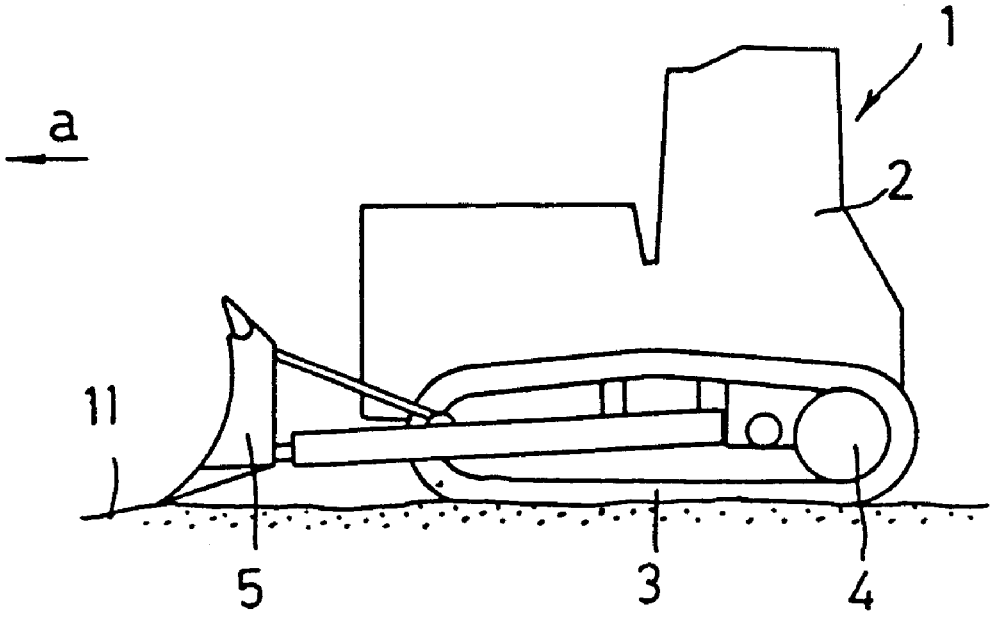
Figure 13:
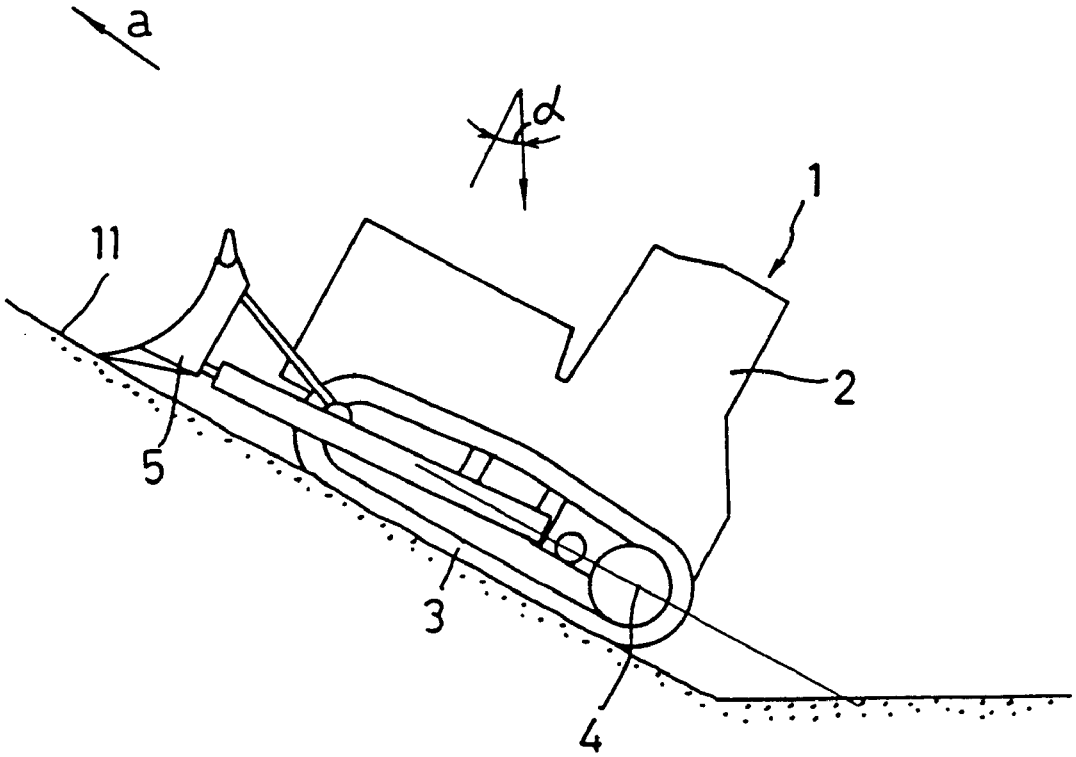

T5: If the equation (6) does not hold, in other words, the moment $F_V\times L_B$ of the reaction force $F_V$ exerted on the blade 5 is not greater than the moment $W\times L_W$ of the weight W of the vehicle, the bulldozer 1 is deemed not to be in the idler floating condition so that the output α of the inclinometer is determined as the angle of travel direction of the vehicle body 2 irrespective of whether the bulldozer 1 drives on flat ground as shown in FIG. 12 or on a slope as shown in FIG. 13.

T6: The bulldozer 1 is deemed to have driven at the speed v for the time period αt in the travel direction obtained by the above-described steps. Then, the excavated shape memory data stored in the memory is updated to terminate the flow.

In this way, the accurate vehicle speed of the bulldozer 1 with respect to the ground and the accurate angle of travel direction of the vehicle body 2 are obtained. The obtained vehicle speed is integrated in the direction of the obtained travel direction angle, whereby the travel route of the bulldozer 1, in other words, the present position of the bulldozer 1 can be accurately established. This enables easy automatic driving of the bulldozer 1.

In the invention, the pitch angle of the vehicle may be obtained from the output of a pitch angle sensor. The blade reaction force may be obtained from the axial force of the blade lift cylinders or alternatively from the output of a load sensor attached to the mounting pin of the blade lift cylinder. The angle of the implement may be obtained from a a sensor that senses the angle of a yoke for mounting the blade lift cylinder, or from a stroke sensor.

We claim:

1. A bulldozer location system for determining the present position of a bulldozer by obtaining the distance the bulldozer has traveled from a digging start position, the system comprising:

(1) actual tractive force detecting means for detecting the actual tractive force exerted on a blade;

(2) determining means for determining whether the actual tractive force detected by the actual tractive force detecting means exceeds a predetermined shoe slip threshold value;

(3) vehicle speed detector switching means for switching from one vehicle speed detector means to another according to the determination by the determining means such that one of a plurality of vehicle speed detector means is selected for use in detecting the vehicle speed of the bulldozer; and (4) travel distance calculating means for obtaining the travel distance by integrating the vehicle speed detected by the selected vehicle speed detector means.

2. A bulldozer location system according to claim 1, wherein the vehicle speed detector switching means switches to a first vehicle speed detector means incorporating a Doppler sensor when the determining means determines that the detected actual tractive force exceeds the predetermined shoe slip threshold value, and switches to a second vehicle speed detector means which detects vehicle speed from the rotating speed of sprockets for crawler belts when the determining means determines that the detected actual tractive force does not exceed the predetermined shoe slip threshold value.

3. A bulldozer location system according to claim 1 or 2, wherein said predetermined shoe slip threshold value is set to the lower limit of the variation range of shoe slip which varies depending on soil property.

4. A bulldozer location system according to claim 1 or 2, further comprising (1) pitch angle detecting means for detecting the pitch angle of a vehicle body; (2) implement reaction force detecting means for detecting the reaction force exerted on an implement; (3) implement angle detecting means for detecting the angle of the implement relative to the vehicle body; and (4) travel direction angle calculating means for calculating the angle of travel direction of the vehicle based on outputs from the pitch angle detecting means, the implement reaction force detecting means and the implement angle detecting means.

5. A bulldozer location system according to claim 4, wherein said travel direction angle calculating means calculates the angle of travel direction of the vehicle by subtracting the implement angle detected by the implement angle detecting means from the pitch angle of the vehicle body detected by the pitch angle detecting means, when the reaction force detected by the implement reaction force detecting means exceeds a predetermined value.

6. A bulldozer location system according to claim 4, wherein the pitch angle detecting means detects the pitch angle of the vehicle body from the output of a pitch angle sensor.

7. A bulldozer location system according to claim 4, wherein the implement reaction force detecting means detects the reaction force exerted on the implement from the oil pressure supplied to an implement cylinder.

8. A bulldozer location system according to claim 4, wherein the implement reaction force detecting means detects the reaction force exerted on the implement from the axial force of a cylinder.

9. A bulldozer location system according to claim 4, wherein the implement reaction force detecting means detects the reaction force exerted on the implement from the load exerted on a cylinder mounting pin.

10. A bulldozer location system according to claim 4, wherein the implement angle detecting means detects the angle of the implement from the output of a sensor for sensing the angle of a yoke for mounting an implement cylinder.

11. A bulldozer location system according to claim 4, wherein the implement angle detecting means detects the angle of the implement from the output of a cylinder stroke sensor.

* * * * *